US011505899B2

(12) United States Patent
Dong et al.

(10) Patent No.: US 11,505,899 B2
(45) Date of Patent: Nov. 22, 2022

(54) ANTI-ICING SURFACE WITH POLYMERIC SUPPORTS

(71) Applicant: nVENT SERVICES GmbH, Schaffhausen (CH)

(72) Inventors: Wesley Dong, Belmont, CA (US); William Jarvis, Millbrae, CA (US)

(73) Assignee: nVent Services GmbH, Schaffhausen (CH)

( * ) Notice: Subject to any disclaimer, the term of this patent is extended or adjusted under 35 U.S.C. 154(b) by 329 days.

(21) Appl. No.: 16/710,357

(22) Filed: Dec. 11, 2019

(65) Prior Publication Data

US 2020/0181851 A1 Jun. 11, 2020

Related U.S. Application Data

(60) Provisional application No. 62/775,740, filed on Dec. 5, 2018.

(51) Int. Cl.
*E01C 11/24* (2006.01)

(52) U.S. Cl.
CPC ..... *E01C 11/245* (2013.01)

(58) Field of Classification Search
CPC ..... E01C 11/245; E01C 11/24; E01C 13/04; E01C 15/00
USPC ..... 404/34–36, 77, 79, 95, 71, 72, 75
See application file for complete search history.

(56) References Cited

U.S. PATENT DOCUMENTS 2,912,555 A 11/1959 Jamison
3,330,035 A 7/1967 Pradenas
3,808,403 A 4/1974 Kanaya et al.
4,628,187 A 12/1986 Sekiguchi et al.
5,023,428 A 6/1991 Hegstad
5,380,988 A 1/1995 Dyer
5,550,350 A 8/1996 Barnes
5,865,004 A 2/1999 Mitchell
6,188,839 B1 2/2001 Pennella
6,211,493 B1 * 4/2001 Bouman ..... E01C 11/265 219/528
6,423,951 B1 7/2002 Elsasser
6,552,310 B1 4/2003 Hulldin et al.
6,592,288 B2 7/2003 Chun
(Continued)

FOREIGN PATENT DOCUMENTS

CN 106114808 A 11/2016
EP 0567290 B1 10/1993
(Continued)

OTHER PUBLICATIONS

AMS, Artic Pad, product information, Apr. 6, 2020, 7 pages.
(Continued)

*Primary Examiner* — Raymond W Addie
(74) *Attorney, Agent, or Firm* — Quarles & Brady LLP

(57) ABSTRACT

A deicing cassette for connection to a substrate is provided. The deicing cassette includes a panel having a top, an underside, and a plurality of edges, the top of the panel configured as a walking surface. The deicing cassette further includes a heating system secured in thermal contact with the underside of the panel. Additionally, the deicing cassette includes a polymeric support system fastened to at least one edge of the panel and configured to support the panel and provide the panel at least one of thermal insulation or galvanic insulation from the substrate.

19 Claims, 7 Drawing Sheets

(56) References Cited

U.S. PATENT DOCUMENTS

| | | | | |
|---|---|---|---|---|
| 6,715,956 | B1 * | 4/2004 | Weber | E01C 5/20 404/22 |
| 7,170,038 | B2 | 1/2007 | Butler | |
| 7,223,948 | B2 | 5/2007 | Howick et al. | |
| 7,401,441 | B2 | 7/2008 | Zimmerle et al. | |
| 7,579,574 | B2 | 8/2009 | Butler | |
| 3,145,047 | A1 | 3/2012 | Gagnon | |
| 9,084,302 | B2 | 7/2015 | Chang et al. | |
| 9,163,365 | B2 | 10/2015 | Solis | |
| 9,546,455 | B2 | 1/2017 | Forbes | |
| 10,036,559 | B2 | 7/2018 | Szekely | |
| D832,468 | S | 10/2018 | Jones et al. | |
| 10,156,045 | B2 | 12/2018 | Penland et al. | |
| 10,156,047 | B2 | 12/2018 | Szekely | |
| 2002/0106499 | A1 | 8/2002 | Cartier | |
| 2004/0035853 | A1 * | 2/2004 | Pais | H05B 3/36 392/432 |
| 2004/0109681 | A1 | 6/2004 | Yue | |
| 2006/0265975 | A1 | 11/2006 | Geffe | |
| 2007/0102243 | A1 * | 5/2007 | Ruminski | E01C 5/20 182/222 |
| 2008/0031604 | A1 | 2/2008 | Kerschbaum | |
| 2009/0236327 | A1 | 9/2009 | Everly et al. | |
| 2010/0170889 | A1 | 7/2010 | Keite-Telgenbuscher et al. | |
| 2010/0282442 | A1 | 11/2010 | Sukuvoy | |
| 2012/0067868 | A1 | 3/2012 | Casey | |
| 2012/0263524 | A1 * | 10/2012 | Wijnant | E01F 8/0094 404/71 |
| 2015/0034067 | A1 | 2/2015 | Szekely | |
| 2016/0014847 | A1 | 1/2016 | Jeong et al. | |
| 2016/0050718 | A1 | 2/2016 | Follman | |
| 2016/0153669 | A1 | 6/2016 | Szekely | |
| 2016/0201272 | A1 | 7/2016 | Perkins | |
| 2017/0067653 | A1 | 3/2017 | Forsbom | |
| 2017/0191228 | A1 | 7/2017 | Dong | |
| 2017/0211241 | A1 | 7/2017 | Calinescu et al. | |
| 2017/0349240 | A1 | 12/2017 | Fertig | |
| 2018/0339569 | A1 | 11/2018 | Teneycke et al. | |

FOREIGN PATENT DOCUMENTS

| | | | |
|---|---|---|---|
| EP | 0859537 | B1 | 8/1998 |
| EP | 0866640 | A2 | 9/1998 |
| EP | 1408156 | A1 | 4/2004 |
| EP | 2071246 | A2 | 6/2009 |
| EP | 3204695 | A1 | 8/2017 |
| EP | 2853478 | B1 | 3/2018 |
| FR | 2698432 | A1 | 5/1994 |
| KR | 101074720 | B1 | 10/2011 |
| KR | 20120018067 | A | 2/2012 |
| KR | 20140070221 | A | 6/2014 |
| KR | 101484691 | B1 | 1/2015 |
| KR | 20150004142 | A | 1/2015 |
| WO | 9722465 | A1 | 6/1997 |
| WO | 2004048854 | A1 | 6/2004 |
| WO | 2016114417 | A1 | 7/2016 |
| WO | 2017152980 | A1 | 9/2017 |

OTHER PUBLICATIONS

OneCo Solutions AS, Winderization—Safe walkways, product information, undated, 1 page.

Raychem, Don't Get Left Out In The Cold Winterization Techniques For Offshore And Marine Environments—New Standards And Design Approaches, product information, Copyright 2017 Pentair, 22 pages.

Stamas, Artic Pad, product information, undated, 5 pages.

Thermon, Artic Offshore and Maritime Heating Solutions, product information, Copyright Thermon Manufactuing Co., undated, 8 pages.

Thermon Europe B.V., Looking for a Panel solution for winterization Offshore Class notation: Cold? PolarPanel advantages are:, LinkedIn screen shot, undated, 1 page.

* cited by examiner

ANTI-ICING SURFACE WITH POLYMERIC SUPPORTS

CROSS-REFERENCE TO RELATED APPLICATIONS

This application claims priority from U.S. Provisional Patent Application No. 62/775,740 filed Dec. 5, 2018, the disclosure of which is incorporated herein by reference in its entirety.

BACKGROUND

In sub-freezing climates, snow and ice accumulation on surfaces can affect all types of structures that are exposed to the environment. In particular, roadways, driveways, sidewalks, and roofs and gutters of buildings may be susceptible to ice build-up and related damage. Additionally, there are considerations associated with working at certain worksites such as oil platforms and ships with exposed decks and passageways in freezing temperatures. Snow-melting and de-icing systems exist for applying heat to the snow and ice, or to the snow-/ice-covered surfaces, referred to herein as "heated surfaces." The thermal energy melts the snow and ice and reduces the associated hazards.

Heated surfaces can generally include a conductive walking surface with a thermal generation system fastened to the underside of the walking surface. The conductive walking surface can be supported by a support system, generally made of metal. The support may rest on a substrate including, but not limited to, walkways, stairs, or decks of oil platforms or ships. The conductive walking surface can utilize metals such as aluminum or steel to transfer heat from the thermal generation system to the walking surface. Heat loss from a conductive walking surface can decrease the energy efficiency and effectiveness of the thermal generation system.

SUMMARY

Accordingly, an improved heated surface that is energy efficient is desired.

In accordance with some embodiments of the invention, a deicing cassette for connection to a substrate is provided. The deicing cassette includes a panel having a top, an underside, and a plurality of edges, the top of the panel configured as a walking surface. The deicing cassette further includes a heating system secured in thermal contact with the underside of the panel. Additionally, the deicing cassette includes a polymeric support system fastened to at least one edge of the panel and configured to support the panel and provide the panel at least one of thermal insulation or galvanic insulation from the substrate.

In accordance with some embodiments of the invention, a heating cassette for connection to a substrate is provided. The heating cassette includes a conductive panel having a top, an underside, and a plurality of edges, the top of the panel configured as a walking surface. The heating cassette further includes a heating system, having a heat tracing cable secured in thermal contact with the underside of the panel. The heating cassette further includes a polymeric support system, including at least one side support fastened to a first edge of the panel, at least one panel flap fastened to a second edge of the panel, and at least one center support disposed on a central portion of the underside of the panel. The polymeric support system is configured to insulate the underside of the panel from the substrate.

These and other objects, features, and advantages of the invention will become apparent upon reading the following detailed description of exemplary embodiments of the invention, when taken in conjunction with the appended claims.

DETAILED DESCRIPTION

Figure 1:
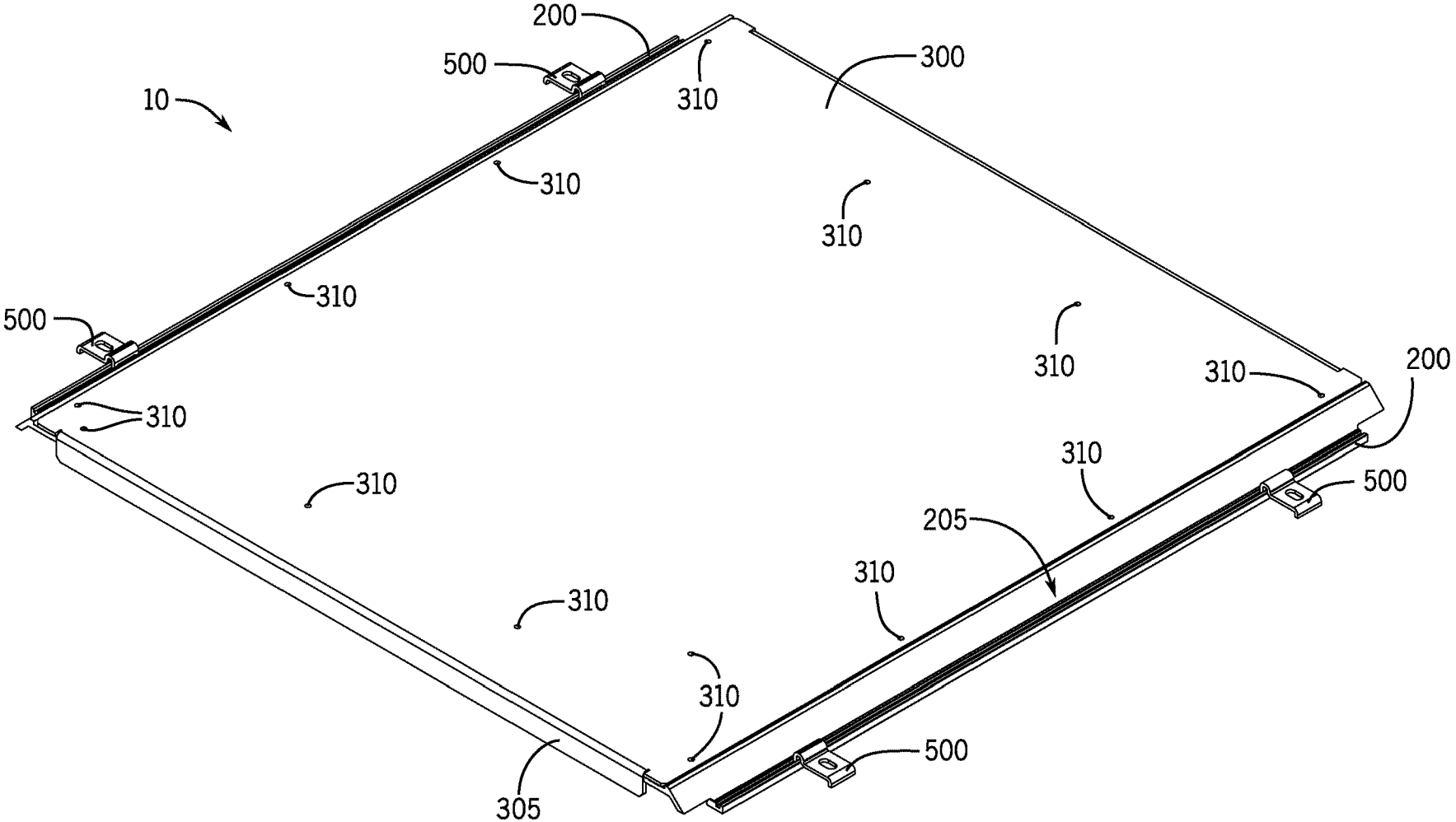
FIG. 1 is an isometric view of a cassette, according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

As described above, conductive surfaces (e.g., conductive walking surfaces) can be supported by a support system, generally made of metal. The support may rest on substrates such as walkways, stairs, or decks of oil platforms or ships. While metals can be an optimal material for transferring heat in order to melt snow and ice, they can cause the heated surface to operate inefficiently. If the support system is constructed of metal, excess thermal energy may be conducted into the substrate, which is also commonly made of metal. Metal support systems can also cause convective heat transfer from surfaces that are not used for walking, such as the sides of the walking surface. Any convective heat transfer that originates from a surface not used for walking can cause the heated surface to operate inefficiently.

Metal support systems may also be susceptible to wear and tear such as corrosion, particularly if the support system is made from aluminum. While aluminum can be lightweight and strong (as well as an optimal conductor of thermal energy), it can cause a voltage to form between the support system and the substrate. Substrates can typically be made from irons or steels, which can form a voltage between the aluminum support system when in or around seawater. The voltage can cause corrosion to occur in the aluminum support system, thus shortening the lifespan of the heated surface. Embodiments of the invention provide an improved heated surface that can be lightweight, energy efficient, and/or corrosion-resistant.

Embodiments of the invention include a cassette, which used herein, is generally defined as a panel that includes an outer, heated surface. The heated surface can correspond to a walking surface, according to some embodiments. Heating of the cassette surface can be performed via an onboard heating system. In some embodiments, the cassette can be modular, so that a single cassette may be used as a standalone system, or alternatively, multiple cassettes may be installed or otherwise joined together as a larger, connected system.

Some embodiments of the invention include a polymeric support system which can support the panel when the cassette is installed. In some embodiments, the polymeric support system may provide galvanic insulation. As an example, the polymeric support system can contact a substrate (e.g., a substrate that the cassette is installed upon), so that the panel is prevented from contacting the substrate. The polymeric support system can help prevent a voltage from forming between the substrate and the panel. Existing systems utilize aluminum (or other conductive materials) within support structures, making the system susceptible to formation of undesired voltages.

The invention may be used in a variety of environments. In particular, heated surfaces may be desirable in areas where snow and/or ice accumulation occurs. Such environments include, but are not limited to, industrial freezers and warehouses, exterior sidewalks in cold climates, ships, and oil platforms. In one example, a ship contains a variety of uninsulated surfaces, such as, decks, walkways, stairs and handrails, or other surfaces throughout the ship that are generally exposed to the elements.

Figure 2:
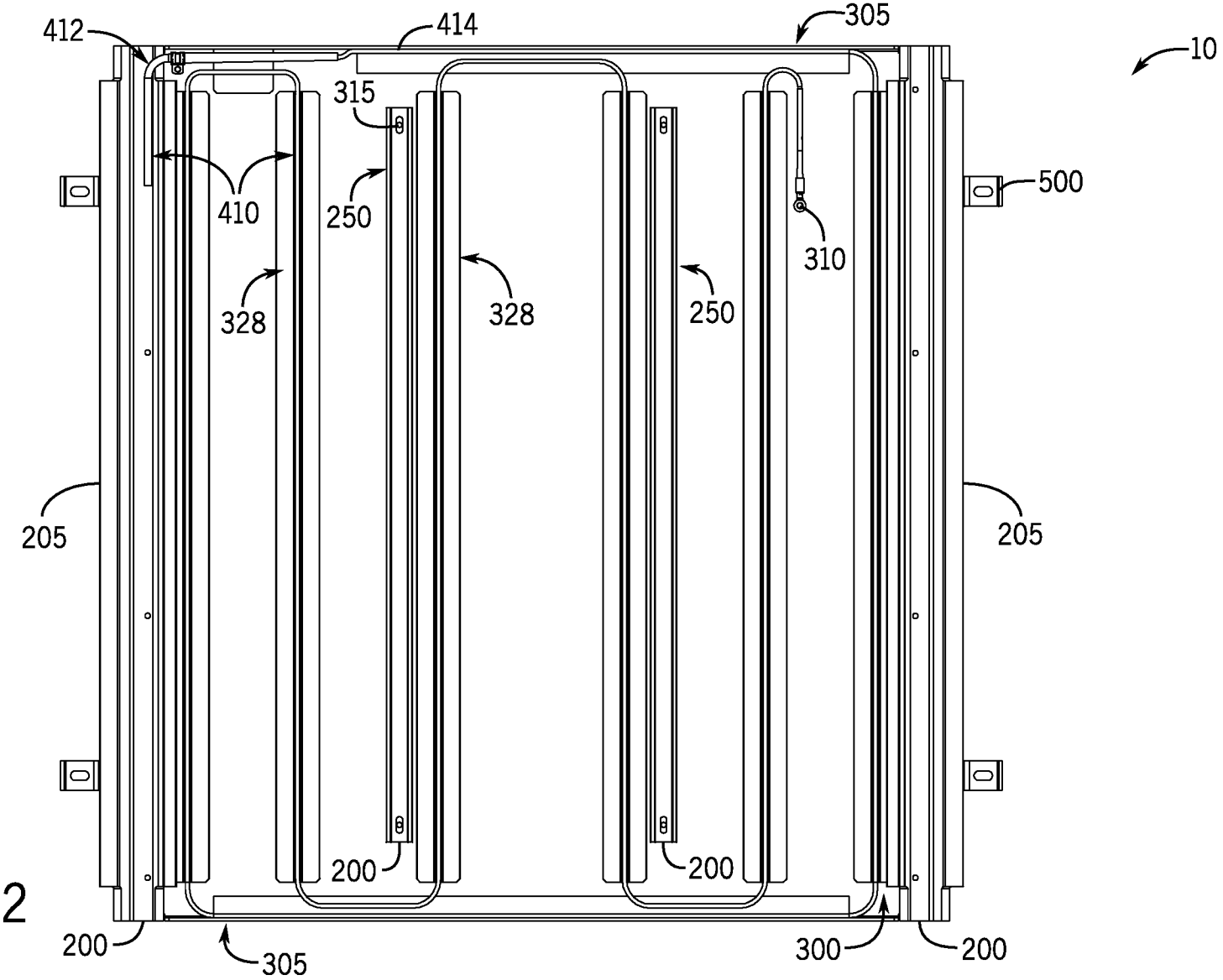
FIG. 2 is an underside of the cassette of FIG. 1, according to one embodiment of the invention.
Figure 3:
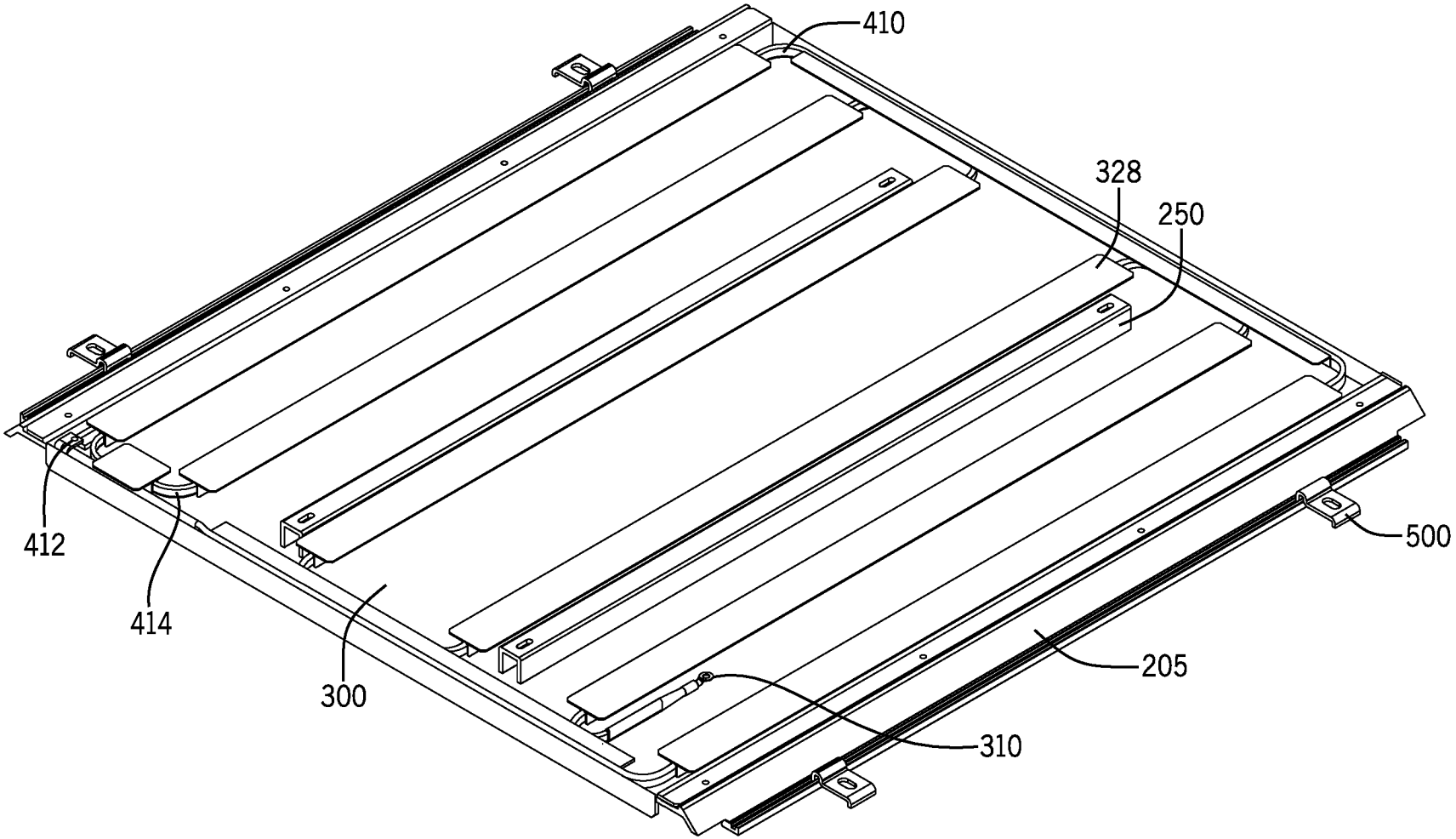
FIG. 3 is a top cutaway view of the cassette of FIG. 1, according to one embodiment of the invention.

FIGS. 1-5 illustrate a cassette 10, according to one embodiment of the invention. As shown in FIG. 1, the cassette 10 may include a panel 300 with an upper walking surface, a polymeric support system 200 for supporting the panel 300 when the cassette 10 is installed, and a heating system. As shown in FIGS. 1 and 2, one or more clamps 500 may be used to fasten the cassette 10 to the substrate. As shown in FIGS. 2-3, the heating system can include a heat tracing cable 410, which is in thermal contact with an underside of the panel 300 in order to heat the panel 300. In response to the heat, accumulated ice and snow melts (e.g., from the walking surface of the panel 300).

In some embodiments, the panel 300 may be made of a conducting material such as aluminum or steel. Additionally, the panel 300 may be made from formed sheet metal or an extruded profile. The top of the panel 300 may have a textured surface (e.g., a diamond plate) in order to provide improved traction. As shown in FIG. 1, the panel 300 may include one or more thru holes 310. The thru holes 310 can help secure the panel 300 to the polymeric support system 200. In some embodiments, the thru holes 310 can be filled (e.g., plugged) with studs. The studs can be, for example, swaged into the thru holes 310, facing downward.

Figure 4:
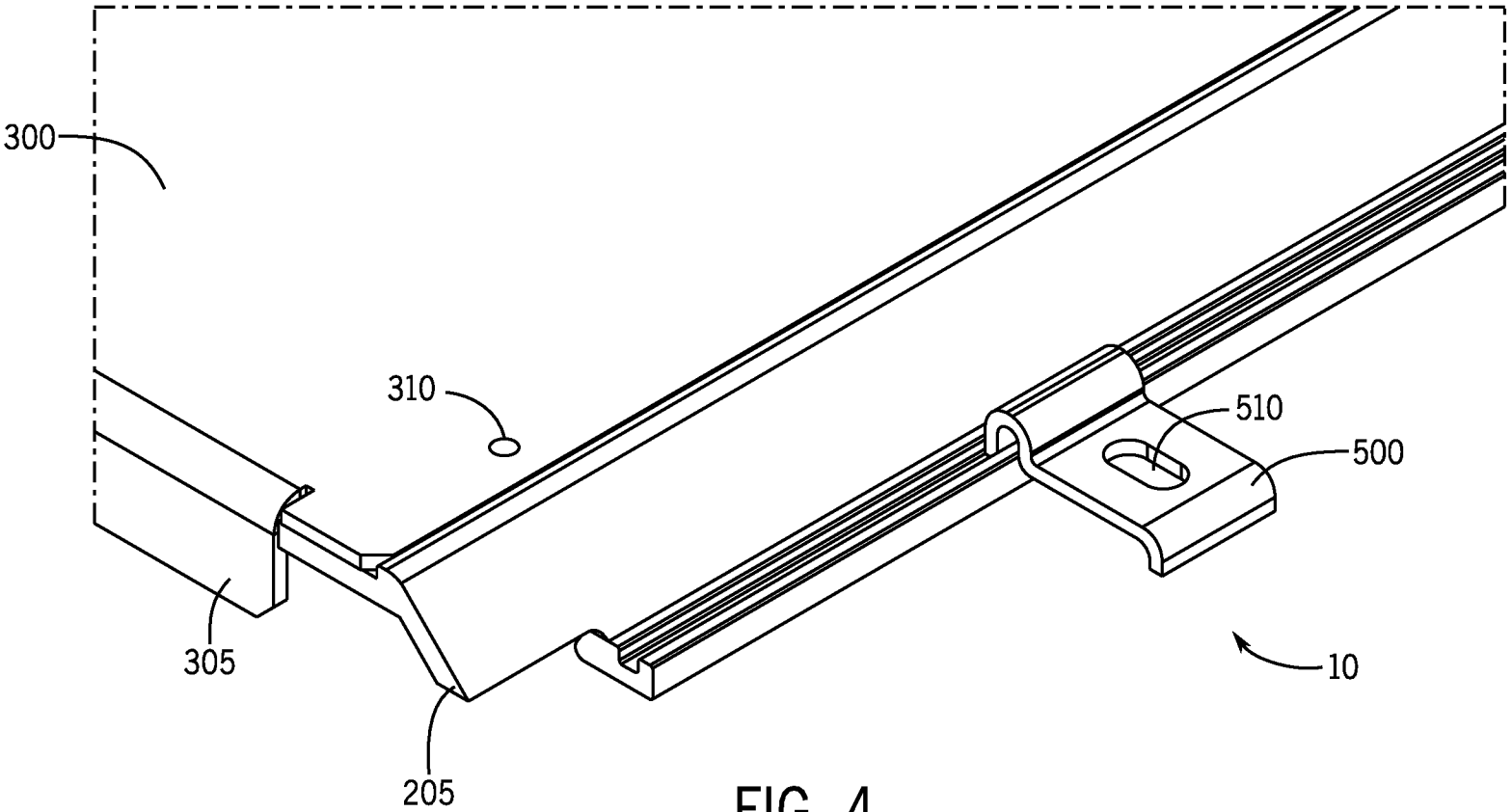
FIG. 4 is an isometric view of a side support of a polymeric support system of the cassette of FIG. 1, according to one embodiment of the invention.

The panel 300 may have one or more edges. As shown in FIGS. 2 and 4, each panel edge can have a panel flap 305, be supported by a side support 205 (e.g., corresponding to the polymeric support system), or include a combination thereof. The panel 300 and panel flaps 305 may be formed or extruded. Alternatively, the panel flaps 305 may be welded to the top of the panel 300. In some configurations, a panel flap 305 corresponding to a first panel 300 may abut a panel flap 305 of a second panel 300.

The polymeric support system 200 may be made from a suitable plastic or elastomer having sufficient strength to support a walking surface on an oceangoing vessel or an industrial environment. Fiber reinforced polyester ("FRP") may be used because it can be pultruded or extruded in near-net form (i.e., utilizing little or no machining to complete which can result in stronger components). FRP is stiff, strong, and relatively lightweight, as well as resistant to low temperatures and saltwater. Other extruded plastics such as nylon may also be suitable. In some embodiments, molded rubber parts may be suitable for elements of the support system 200. The polymeric support system 200 can be made using a pultrusion process.

The polymeric support system 200 may be used to support the panel 300 and/or provide galvanic insulation by preventing the panel 300 from contacting a substrate which the polymeric support system 200 may rest on. The substrate may be a floor or stairs of a ship, oil rig, or other surface that can be exposed to seawater. If the substrate is an iron or iron-based alloy (e.g., Type 316 stainless steel [passive or active], Type 304 stainless steel [passive or active], HSLA steel, CorTen, mild steel, cast iron, or wrought iron), a voltage may form between the substrate and the panel 300 if contact is made between the substrate and the panel 300 in enough seawater. Specifically, if the panel 300 is made of aluminum, the voltage may be up to 0.5 volts in seawater. The voltage can cause undue corrosion of the panel 300. Accordingly, it can be of great benefit to galvanically isolate the panel 300 from the substrate via the polymeric support system 200.

In addition, the polymeric support system 200 can provide thermal insulation between the panel 300 and the heating system, and/or the substrate. The polymeric support system 200 can have properties such as a relatively long conductive path as well as a small cross sectional area and low thermal conductivity. These properties in conjunction with the polymeric construction can make the polymeric support system 200 thermally insulating.

In some embodiments, the polymeric support system 200 can also provide convective energy insulation for the cassette 10. The polymeric support system 200 can, for example, reduce convective heat transfer compared to if the polymeric support system 200 was constructed of a metal. This reduction occurs via lowering the exposed surface area of metals in the cassette 10.

In some embodiments, the panel 300 may be conductive in order to transfer heat from a heating system. As shown in FIGS. 2-3, the heating system can be a heat tracing cable 410. As shown, the heat tracing cable 410 can have a power conduit section 412 and a heating section 414. The power conduit section 412 may be used to power the heating section 414. Further, the heating section 414 may radiate heat, while the power conduit section 412 may not radiate heat. In some embodiments, the heat tracing cable 410 may be fastened in place with tape. The tape may be any suitable adhesive tape, but advantageously may include properties that improve heat transfer from the heat tracing cable 410 to the panel 300, such as a high thermal conductivity. As an example, the tape may be aluminum tape that helps improve to heat transfer and minimize temperature gradients.

Other mechanisms for adhesively or non-adhesively securing the heat tracing cable 410 to the panel 300 may be used. In some embodiments, as shown in FIGS. 2-3, the panel 300 may have clips 328 for securing the heat tracing cable 410 to the panel 300. The heat tracing cable 410 may be installed in a serpentine fashion in thermal contact with the underside of the top of the panel 300 and fastened in place with the clips 328. In some embodiments, the clips 328 may be configured as channels, and can be filled with a thermal compound that contacts the heat tracing cable 410. Additionally, as shown in FIG. 2, the heat tracing cable 410 may be fastened to the panel 300 using a fastener. The fastener may be fastened, for example, to one of the thru holes 310.

The heat tracing cable 410 may be a suitable heater cable for heating a metal or other corrosion-resistant walkway panel in extreme environments. The heat tracing cable 410 may be chosen from shielded heating cables and may be self-regulating (e.g. Raychem BTV, Raychem QTVR, or similar), constant wattage (e.g. Raychem XPI or similar), or another suitable type of cable. Alternatively, in place of using a heat tracing cable 410 as the heating system, a pre-fabricated heating pad (e.g., silicone heating mat, or similar) may be used. Pre-fabricated heating pads may have some advantages over self-regulating cable in that inrush currents are less, and heat generation is closer to the surface that requires heat (i.e., the top surface of the cassette 10).

As shown in FIGS. 1-3, the polymeric support system 200 can include one or more side supports 205 and/or one or more center supports 250. The center supports 250 may provide additional support near the center of the panel 300, which may be under greater stress than the sides of the panel. The center supports 250 may be fastened to the panel 300 using one or more fasteners 315 fastened to one or more thru holes 310. The side supports 205 and/or center support(s) 250 may be constructed of the above-described polymeric materials, and may be pultruded to attain manufacturing efficiencies as well as the desired material properties. As shown in FIG. 3, thru holes 310 may be configured as an earthing stud connection. In some embodiments, the thru holes 310 can be filled (e.g., plugged) with studs. The studs can be swaged into the thru holes 310, facing downward.

Figure 5:
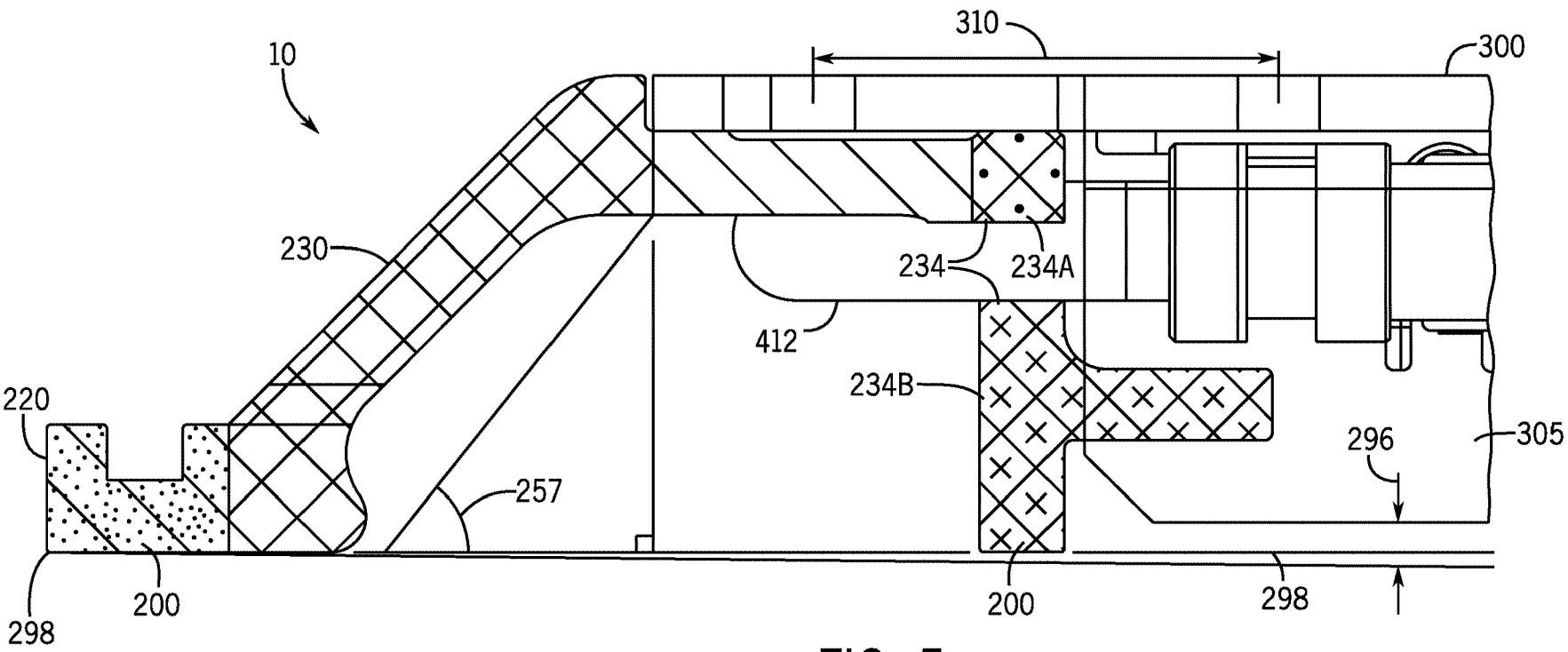
FIG. 5 is a cross-sectional view of a side support of a polymeric support system of the cassette of FIG. 1, according to one embodiment of the invention.

FIGS. 4-5 illustrate the panel 300 supported above the substrate by side supports 205 of the polymeric support system 200. In some embodiments, the side support 205 can be fastened to the panel 300 using one or more fasteners fastened to one or more thru holes 310. As shown, the side support 205 can be used to support an edge of the panel 300. As shown in FIG. 5, the side support 205 can have an inner support wall 234.

Figure 7:
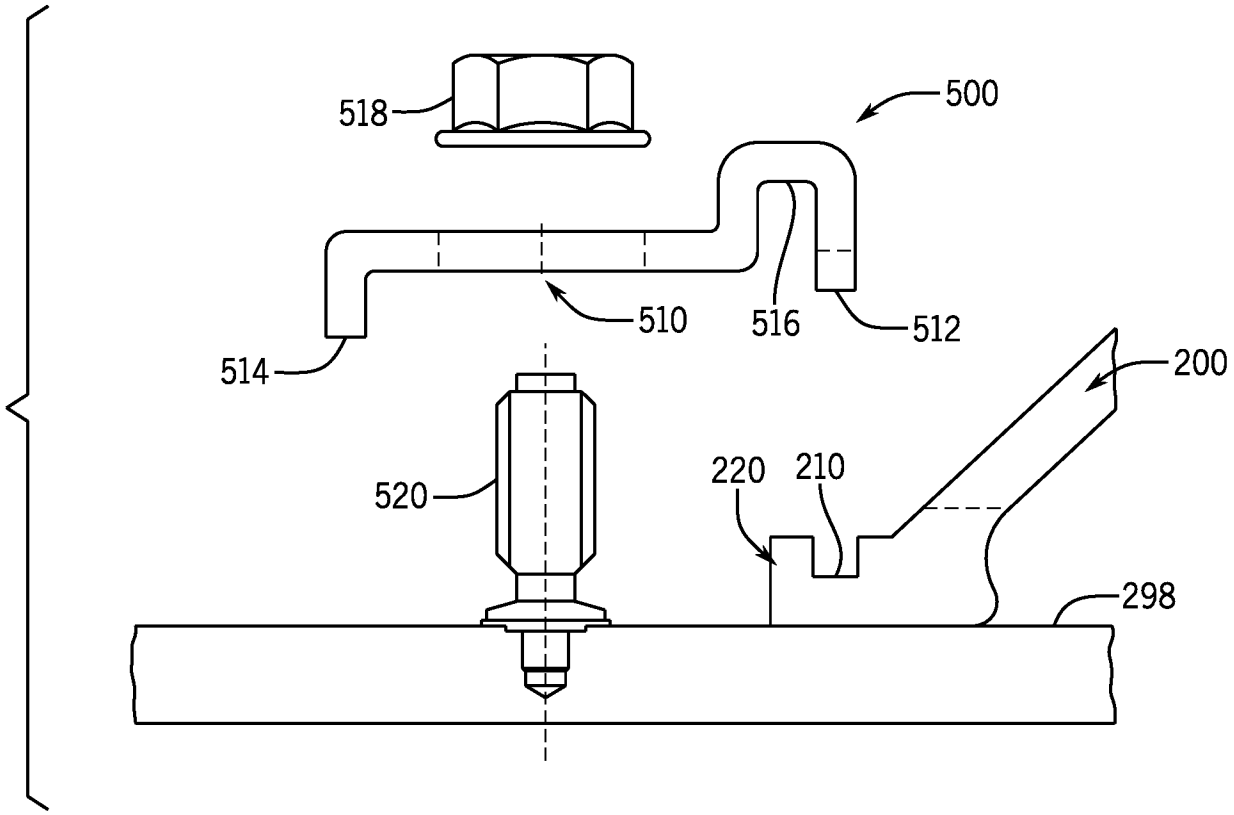
FIG. 7 is a front view of a cassette fastener, according to one embodiment of the invention.

As shown in FIG. 5, the side support 205 may have an outer support wall 230. The outer support wall 230 can be used to support the panel 300 as well as provide a thermal barrier between the substrate and the panel 300. The outer support wall 230 may extend from the panel 300 to the substrate at an outer support angle 257. The outer support angle 257 can be between 30 degrees to 90 degrees. In some embodiments, the outer support angle 257 may be about 45 degrees, which can minimize height as well as allow the cassette 10 to comply with DNV GL safety standards. In some embodiments, the side support 205 may have a sliding groove 220. The sliding groove 220 may be sized to accommodate a clamp 500, as shown in FIG. 7.

In some locations, the side support 205 may not rest on the substrate. More specifically, near a meeting point of two edges of the panel 300, a first wire routing gap may be formed the between the side support 205 and the substrate. The first wire routing gap may be used for routing of wires and/or cables. The first wire routing gap may allow the routing of cables even after the cassette 10 has been installed.

In some embodiments, the panel 300, panel flap 305, and/or side support 205 may abut another panel 300, panel flap 305, and/or side support 205 of another cassette 10 in order create a modular walkway system. The panel flap 305 can be particularly useful because it can maintain an approximately flat edge of the cassette 10 for abutting another cassette 10. If two cassettes 10 are abutted, the panel flaps 305 do not lose excessive heat to convection, as at least a portion of the panel flaps 305 may not be exposed to air. Additionally, if the cassette 10 is at the end of a walkway, and the panel flap 305 is exposed, then the panel flap 305 may help trap air under the top of the panel 300 in order to preserve thermal insulation. In an alternative embodiment, the cassette 10 can have an edge of the panel 300 without a panel flap 305, still abutted to the edge of another panel 300 of a second cassette 10, regardless of whether or not the edge of the second cassette 10 has a panel flap 305.

FIG. 5 illustrates a cross-sectional view of one embodiment of the side support 205. The inner support wall 234 can be used to support the panel 300 as well as provide a thermal barrier between the substrate and the panel 300. There may be a cable routing area disposed between the inner support wall 234 and the outer support wall 230, which can be used for routing cables such as the power conduit section 412. Additionally, the cable routing area may be used for routing other cables that may be used on a ship or oil rig.

As shown in FIG. 5, portions of the bottoms of the outer support wall 230, the sliding groove, and/or the inner support wall 234 may be located approximately on a plane 298, allowing the outer support wall 230, the sliding groove, and/or the inner support wall 234 to rest on the substrate. In some embodiments, the outer support wall 230 may be about 3 centimeters tall. If a portion of the side support 205 rests on the substrate, a layer of dead air may be trapped between the side supports 205, the panel 300, and the substrate. In applications where the substrate is partially open, such as an open grating walkway, a layer of rubber may be disposed between the substrate and the polymeric support system 200. In some embodiments, the layer of rubber may be about 3 millimeters thick. The layer of dead air may allow the cassette 10 to forgo an insulation layer that other designs may require, thus saving manufacturing costs and/or weight.

In some embodiments, the bottom of the panel flap 305 may be located above the plane 298, forming a gap 296. The gap 296 can be about 1-10 millimeters. The gap 296 can allow water to drain if a hole is formed in the panel 300, while preventing excessive air flow under the cassette 10. Additionally, the gap 296 can prevent thermal coupling of the cassette 10 to the substrate.

As shown in FIG. 5, a first portion 234A of the inner support wall 234 may extend further towards the edge of the cassette 10 than a second portion 234B of the inner support wall 234, thus forming a second wire routing gap. The second wire routing gap may be used for routing cables, such as the power conduit section 412 of the wire heat tracing cable 410.

Figure 6:
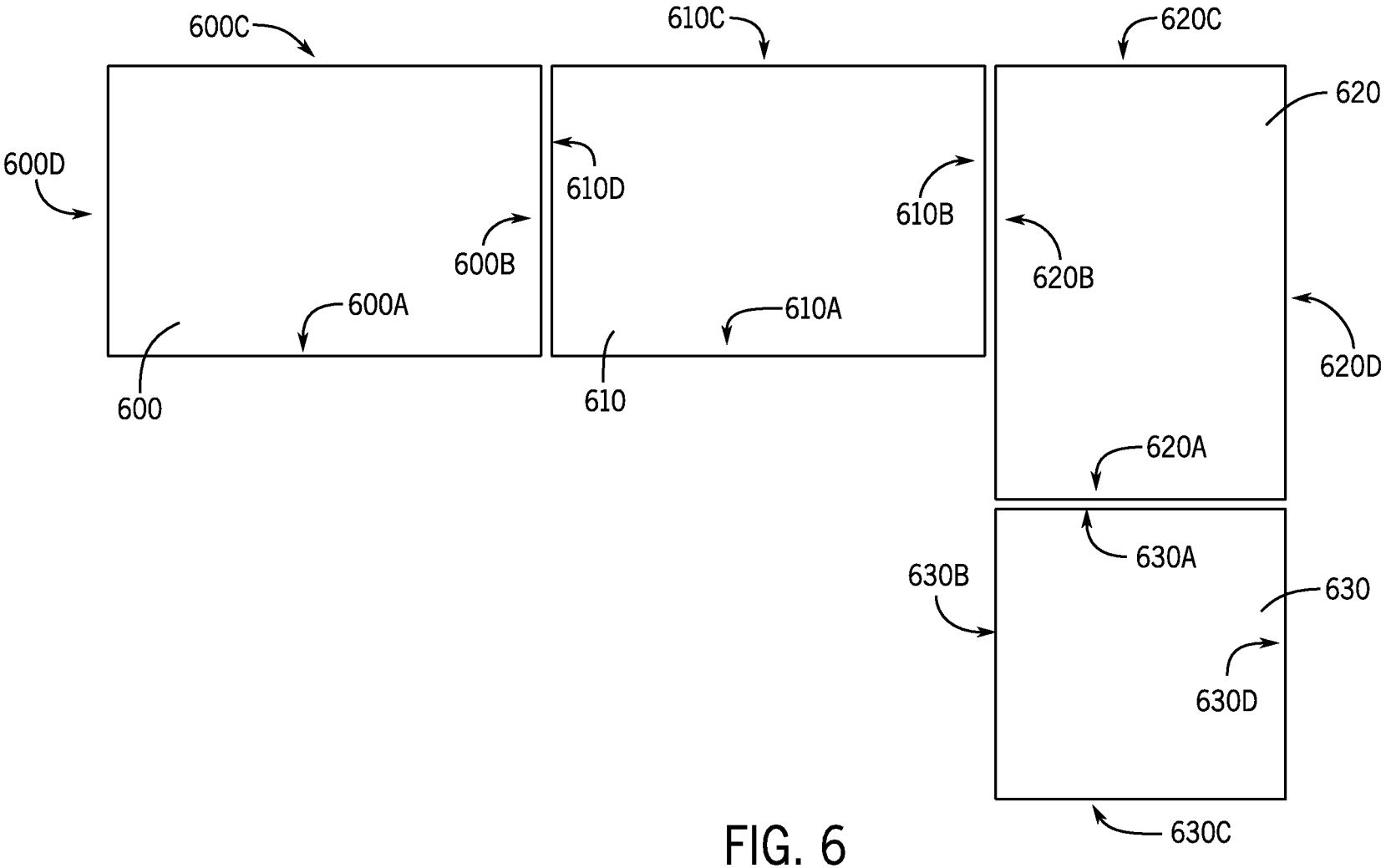
FIG. 6 is an illustration of cassettes, arranged according to one embodiment of the invention.

FIG. 6 illustrates several cassettes 10, arranged for a particular substrate configuration. A first cassette 600 may have a first edge 600A, a second edge 600B, a third edge 600C, and a fourth edge 600D. In some embodiments, the first edge 600A and the third edge 600C can have a different length than the second edge 600B and the fourth edge 600D. The first edge 600A, the third edge 600C, and the fourth edge 600D can each be supported by a side support. The side supports can provide thermal insulation, convective energy insulation, and/or galvanic insulation for a panel 300 of the cassette 10 as described above. Additionally, the second edge 600B may have a panel flap.

In some embodiments, cassettes 10 can be in the shape of a trapezoid, triangle, or L, C, or U-shaped. The various shapes can enable the cassettes 10 to go around obstacles which could be present on an existing ship deck or other industrial setting. Cassettes 10 can be retrofitted onto existing ships or industrial settings, as well as designed into new construction (e.g., new ships, new industrial settings). Cassettes 10 can have folded flap edges or side supports on any side or sides, (or no sides) as desired for path intersections, or to avoid obstacles. As desired, cassettes 10 can be held in place with bolts or barrel nuts mounted via the thru holes 310, and the bolt or nut can be sealed to a top portion of the cassette 10.

A second cassette 610 may have a first edge 610A, a second edge 610B, a third edge 610C, and a fourth edge 610D. In some embodiments, the first edge 610A and the third edge 610C can have a different length than the second edge 610B and the fourth edge 610D. The first edge 610A and the third edge 610C can each be supported by a side support. The side supports can provide thermal insulation, convective energy insulation, and/or galvanic insulation for a panel 300 of the cassette 10 as described above. The second edge 610B and the fourth edge 610D may have a panel flap. The fourth edge 610D may abut the second edge 600B of the first cassette 600. If the panel flaps of the second edge 610B and the fourth edge 610D are abutted, potential convective energy losses (which would have occurred if the flaps were exposed) can be mitigated. Additionally, the side supports of the third edge 600C and the third edge 610C as well as the first edge 600A and the first edge 610A may be abutted in order to provide thermal insulation for the panels 300 by trapping a dead layer of air.

A third cassette 620 may have a first edge 620A, a second edge 620B, a third edge 620C, and a fourth edge 620D. In some embodiments, the first edge 620A and the third edge 620C can have a different length than the second edge 620B and the fourth edge 620D. The first edge 620A may have a panel flap. At least a portion of the second edge 620B may be abutted to the second edge 610B of the second panel 610. The portion of the second edge 620B that abuts the second edge 610B, may have a panel flap in order to prevent potential convection losses as described above. At least a portion of the second edge 620B may be exposed. The exposed portion of the second edge 620B may be supported by a side support in order to provide support as well as provide thermal insulation by trapping a dead layer of air as described above. The third edge 620C and the fourth edge 620D may also be supported by a side support in order to provide support as well as provide thermal insulation by trapping a dead layer of air.

A fourth cassette 630 may have a first edge 630A, a second edge 630B, a third edge 630C, and a fourth edge 630D. The first edge 630A may have a panel flap. The first edge 630A may abut the first edge 620A of the third cassette 620 in order to prevent potential convection losses. The second edge 630B, the third edge 630C, and the fourth edge 630D may be supported by a side support in order to in order to provide support as well as provide thermal insulation by trapping a dead layer of air. The first edge 630A, the second edge 630B, the third edge 630C, and the fourth edge 630D may be approximately the same length.

The cassette 10 (e.g., 600, 610, 620, 630) can have a variety of dimensions and configurations, as illustrated by FIG. 6. In particular, edge types can vary between cassettes 10, based on the desired configuration of a walkway. In some embodiments, the cassette 10 can be square. As an example, the cassette 10 can have edge lengths of approximately 1 meter. In other embodiments, the cassette 10 can be rectangular. As an example, the cassette 10 can have edge lengths of approximately 2 meters by 1 meter. Further, the cassette 10 can have a height of about 35 millimeters.

FIG. 7 illustrates a cassette clamp 500 according to one embodiment of the invention. The clamp 500 can slide along the sliding groove 220 (e.g., during installation), allowing a first axis of freedom for installation of a fastener 520. A first clamp edge 512 can contact and slide within a channel 210. A raised portion 516 of the clamp 500 can help retain the clamp 500 within the channel 210.

The clamp 500 may have a slotted hole 510. The slotted hole 510 may be used with a fastener 520, which can include a bolt 518. The fastener 520 and the bolt 518 can affix the clamp 500 to the substrate. The fastener 520 can extend into the substrate (extending through plane 298, as shown in FIG. 5). A second clamp edge 514 can contact the substrate when the clamp 500 is installed via the fastener 520. Notably, the slotted hole 510 can allow a second axis of freedom for installing the fastener 520 into the substrate.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. Various features and advantages of the invention are set forth in the following claims.

What is claimed is:

1. A deicing cassette for connection to a substrate, the deicing cassette comprising:

a panel having a top, an underside, and a plurality of edges, the top of the panel configured as a walking surface;

a heating system secured in thermal contact with the underside of the panel; and a polymeric support system fastened to at least one edge of the panel and configured to support the panel and provide the panel at least one of thermal insulation or galvanic insulation from the substrate, the polymeric support system comprising a side support fastened to the at least one edge of the panel via one or more fasteners.

2. The deicing cassette of claim 1, wherein the polymeric support system further comprises at least one polymeric support disposed on a central portion of the underside of the panel.

3. The deicing cassette of claim 1, wherein the panel comprises a conductive material, the heating system configured to supply heat to the underside of the panel to conductively heat the walking surface.

4. The deicing cassette of claim 1, wherein the polymeric support system provides convective energy insulation for the deicing cassette.

5. The deicing cassette of claim 1, wherein the side support forms a wire routing gap proximal to the substrate.

6. The deicing cassette of claim 1, wherein the side support and the panel are arranged to form a cavity with the substrate, the cavity including an insulating layer of air.

7. The deicing cassette of claim 1, wherein the polymeric support system comprises fiber reinforced polyester.

8. The deicing cassette of claim 7, wherein the polymeric support system comprises pultruded fiber reinforced polyester.

9. The deicing cassette of claim 1, wherein the side support comprises:

an outer support wall configured to provide a thermal barrier between the substrate and the panel;

an inner support wall configured to provide a thermal barrier between the substrate and the panel; and a cable routing area disposed between the outer support wall and the inner support wall.

10. The deicing cassette of claim 9, wherein a power conduit corresponding to the heating system is disposed within the cable routing area.

11. A deicing cassette for connection to a substrate, the deicing cassette comprising:

a panel having a top, an underside, and a plurality of edges, the top of the panel configured as a walking surface;

a heating system secured in thermal contact with the underside of the panel; and a polymeric support system fastened to at least one edge of the panel and configured to support the panel and provide the panel at least one of thermal insulation or galvanic insulation from the substrate, the polymeric support system comprising at least one panel flap proximal to the at least one edge of the panel.

12. The deicing cassette of claim 11, wherein a portion of the at least one panel flap extends from the top of the panel.

13. The deicing cassette of claim 11, wherein the panel flap is arranged on the panel to contact the substrate to preserve thermal insulation.

14. A heating cassette for connection to a substrate, the heating cassette comprising:

a conductive panel having a top, an underside, and a plurality of edges, the top of the panel configured as a walking surface;

a heating system comprising a heat tracing cable secured in thermal contact with the underside of the panel; and a polymeric support system comprising:

at least one side support fastened to a first edge of the panel;

at least one panel flap fastened to a second edge of the panel; and at least one center support disposed on a central portion of the underside of the panel, the polymeric support system configured to insulate the underside of the panel from the substrate.

15. The heating cassette of claim 14, wherein the polymeric support system comprises pultruded fiber reinforced polyester.

16. The heated cassette of claim 14, wherein the at least one side support comprises an engagement channel configured to receive a cassette fastener.

17. The heated cassette of claim 14, wherein the at least one side support, the at least one panel flap, and the panel are arranged to form a cavity with the substrate, the cavity including an insulating layer of air.

18. The heated cassette of claim 14, wherein the at least one side support comprises:

an outer support wall configured to provide a thermal barrier between the substrate and the panel;

an inner support wall configured to provide a thermal barrier between the substrate and the panel; and a cable routing area disposed between the outer support wall and the inner support wall.

19. The heated cassette of claim 18, wherein a power conduit corresponding to the heat tracing cable is disposed within the cable routing area.

* * * * *